US010486186B2

(12) United States Patent
Belanger

(10) Patent No.: US 10,486,186 B2
(45) Date of Patent: Nov. 26, 2019

(54) NO-DRIP HOT MELT GLUE GUN

(71) Applicant: Adhesive Technologies, Inc., Hampton, NH (US)

(72) Inventor: Richard A. Belanger, Kensington, NH (US)

(73) Assignee: Adhesive Technologies, Inc., Hampton, NH (US)

( * ) Notice: Subject to any disclaimer, the term of this patent is extended or adjusted under 35 U.S.C. 154(b) by 0 days.

(21) Appl. No.: 16/295,083

(22) Filed: Mar. 7, 2019

(65) Prior Publication Data

US 2019/0283073 A1 Sep. 19, 2019

Related U.S. Application Data

(60) Provisional application No. 62/642,759, filed on Mar. 14, 2018.

(51) Int. Cl.
*B05C 17/005* (2006.01)
*B05C 5/02* (2006.01)

(52) U.S. Cl.
CPC ..... *B05C 17/00533* (2013.01); *B05C 5/0225* (2013.01)

(58) Field of Classification Search
CPC ..... B05C 17/00533; B05C 5/0225; B05C 17/00526; B05C 17/0053; B67D 1/1256
USPC ..... 222/146.5
See application file for complete search history.

(56) References Cited

U.S. PATENT DOCUMENTS 2,995,159 A * 8/1961 Berggren ..... B05C 17/0053 141/82
3,877,610 A * 4/1975 Dickey ..... B05C 17/00543 222/146.5
3,960,296 A * 6/1976 Nord ..... B05C 17/00543 222/146.5
3,964,644 A * 6/1976 Wallace ..... B05C 17/00543 222/146.5
4,033,484 A * 7/1977 Ornsteen ..... B05C 17/00533 222/146.5
4,317,529 A * 3/1982 Leibhard ..... B05C 17/00526 222/146.5
4,378,076 A * 3/1983 Stirnweiss ..... B05C 17/0053 222/146.5
4,379,516 A * 4/1983 Barlogis ..... B05C 17/0053 222/146.5
4,664,296 A * 5/1987 Dziki ..... B05C 17/00533 219/230
4,776,490 A * 10/1988 Wingert ..... B05C 17/0053 222/146.5
4,804,110 A 2/1989 Sperry et al.
5,026,187 A * 6/1991 Belanger ..... B05C 17/00533 219/230

(Continued)

FOREIGN PATENT DOCUMENTS

WO 2006/047090 5/2006

*Primary Examiner* — Benjamin R Shaw
(74) *Attorney, Agent, or Firm* — Clark & Brody

(57) ABSTRACT

A hot melt glue gun provides a melt chamber for supplying melted glue to a discharge nozzle. An auxiliary chamber is connected to the melt chamber, and melted glue is drawn from the melt chamber into the auxiliary chamber when discharge of glue is terminated. The glue drawn from the melt chamber reduces the possibility of glue dripping from the discharge nozzle.

8 Claims, 3 Drawing Sheets

(56) References Cited

U.S. PATENT DOCUMENTS 5,105,987 A * 4/1992 Quinn ..... B05C 17/0054 221/279
5,215,230 A * 6/1993 Lee ..... B05C 17/0053 222/146.2
5,375,766 A * 12/1994 Sweeney ..... B05B 7/1606 219/230
5,664,701 A * 9/1997 Massena ..... B05C 17/00526 219/227
5,881,924 A * 3/1999 Bokros ..... B05C 17/00526 219/227
5,901,881 A * 5/1999 Wang ..... B05C 17/00526 126/401
6,065,888 A * 5/2000 Maayeh ..... B05C 17/0053 222/146.2
6,105,824 A * 8/2000 Singleton ..... B05C 17/0053 219/221
6,152,386 A 11/2000 Bullock et al.
6,170,709 B1 * 1/2001 Huang ..... B05C 17/00523 222/146.5
6,460,736 B1 * 10/2002 D'Agostino ..... A23G 1/202 222/146.5
6,558,059 B1 * 5/2003 Hillinger ..... B05C 17/00536 222/146.2
7,367,474 B2 * 5/2008 Lin ..... B05C 17/00526 126/401
7,775,403 B2 * 8/2010 Monfeli ..... B05C 17/00526 219/242
2004/0232165 A1 * 11/2004 Lee ..... B05C 17/0053 222/146.5
2006/0144859 A1 * 7/2006 Lin ..... B05C 17/00526 222/146.6
2006/0191957 A1 * 8/2006 Axinte ..... B05C 17/00526 222/146.5
2006/0196888 A1 * 9/2006 Agronin ..... B05C 17/0053 222/146.5
2008/0073448 A1 3/2008 Kendall
2014/0054319 A1 * 2/2014 Shin ..... B65D 83/14 222/146.5
2015/0083752 A1 * 3/2015 Shin ..... H05B 1/025 222/146.5
2015/0209820 A1 * 7/2015 Ono ..... B05C 17/00546 222/80

* cited by examiner

NO-DRIP HOT MELT GLUE GUN

CROSS REFERENCE TO RELATED APPLICATIONS

This application claims priority from U.S. provisional application Ser. No. 62/642,759, which was filed on Mar. 14, 2018, the entire disclosure of which is hereby incorporated by reference.

TECHNICAL FIELD

This invention relates to the art of hot melt glue guns, and in particular, to hot melt glue guns with a mechanism to reduce dripping of glue from a nozzle after termination of the glue dispensing.

BACKGROUND ART

An undesirable feature of many hot melt glue guns is that they leak from the nozzle opening on warm-up as well as during normal use of the gun. In the typical construction of a glue gun, a user feeds a glue stick at room temperature into a relatively short melt chamber having a temperature in the range of 250° F. to 400° F., depending on the model and the glue stick formulation.

A fundamental property of thermoplastics is its volumetric expansion as a function of temperature—commonly called thermal expansion. The coefficient of thermal expansion for most thermoplastics is known. For most EVA based formulas, the rate of thermal expansion is in the range of 100 micro-inches/inch/degree F., so this translates to about a 5% volumetric expansion.

As the user feeds a glue stick into the melt chamber, the temperature of the melt chamber temporarily drops, because the melt chamber must heat the glue stick from a temperature of about 75° F. to, for example, 350° F. in a relatively short period of time. As the temperature of the glue increases it expands, and the more quickly glue is fed into the melt chamber, the more it is affected by this thermal expansion. This volumetric expansion is the primary cause of leaking in the glue guns.

Use of a glue gun lightly requires only a small amount of cold stick be heated, resulting in a relatively small amount of thermal expansion in a given time period. However, when a glue gun is used heavily, such as when multiple glue sticks are fed serially into the melt chamber rapidly, each complete stick must be heated in a short period of time, resulting in thermal expansion of a large amount of glue in a short time.

For a typical glue stick having a diameter of about 0.450", the thermal expansion can be calculated to be theoretically about 0.15" of linear expansion, which is about 0.025 cubic inches of glue available to drip or drool. For a bead of glue 0.125" in width, a bead of about 2" in length can form from the glue that is available to drool just from thermal expansion. In practice, the glue stick naturally retracts a little bit when dispensing pressure is released, resulting from the release of the pressure on the glue stick that must be applied to open the ball check-valve in the nozzle during dispensing. This slight retraction reduces the pressure in the melt chamber, and the length of a bead of glue after the user stops feeding the glue stick into the melt chamber is in practice typically about 1 inch as the pressure relief is satisfied and the dispensing stops gradually.

In addition many glue guns experience thermal expansion of the solid glue that is already within the chamber on warm up, resulting in an inevitable drip.

SUMMARY OF THE INVENTION

In accordance with the invention, dripping is prevented by rapidly depressurizing the melt chamber when delivery of glue is terminated. In a preferred embodiment, depressurizing is achieved by drawing off, or siphoning, a small portion of the melted glue into an auxiliary chamber that is in fluid communication with the melting chamber. The melt chamber and the auxiliary chamber are connected by a small tube that carries melted glue between the two chambers. As liquid glue flows into the auxiliary chamber, the pressure of the glue throughout the melt chamber, including pressure on the nozzle, is quickly relieved to prevent dripping.

In the preferred embodiments illustrated, melted glue is drawn from the melt chamber into the auxiliary chamber by movement of a piston within the auxiliary chamber. The piston can be about the diameter of a glue stick. The piston moves in direction away from the inlet of the tube to the auxiliary chamber to draw liquid glue from the melt chamber into the auxiliary chamber by increasing the size of the auxiliary chamber and thereby reducing the pressure in the auxiliary chamber. Movement of the piston in an opposite direction forces melted glue from the auxiliary chamber back into the melt chamber. The auxiliary chamber is preferably a cavity that is cylindrical and circular in cross section but it can take other shapes. For example, the cross section need not be circular and the chamber can be other than cylindrical. The cavity can be formed in a solid material, such as plastic or metal, and is preferably formed of cast metal. The auxiliary chamber can also be formed in part of a cast metal body integral with another part forming the melt chamber.

The piston can be spring-loaded to cause it to move in a direction away from the tube upon release of a user's pulling on a trigger in a glue advancement mechanism. This draws glue from the main chamber into an auxiliary chamber and relieves pressure in the main, melt chamber. An assembly of cooperating elements is activated by the glue advancement mechanism which can push the piston toward the passage connected to the melt chamber, thus emptying this additional volume of glue in the auxiliary chamber back into the main melt chamber as glue is dispensed from the melt chamber. When the force applied to the trigger is released, the spring will again push the piston outward, drawing a volume of melted glue from the main chamber with it to relieve the pressure in the main melt chamber or, possibly, creating a slight vacuum within the melt chamber. The outward movement of the piston quickly pulls some of the melted glue away from the main melt chamber, thus also removing glue from within the nozzle to prevent dripping.

Other constructions of the auxiliary chamber are possible. For example, the piston could be replaced by a flexible diaphragm that would draw glue into a chamber of selected shape. Also the auxiliary chamber could comprise two parts with complimentary cavities that move with respect to each other to form a closed cavity of variable volume (e.g., a first tube that slides within a second tube).

DETAILED DESCRIPTION OF THE INVENTION

Figure 1:
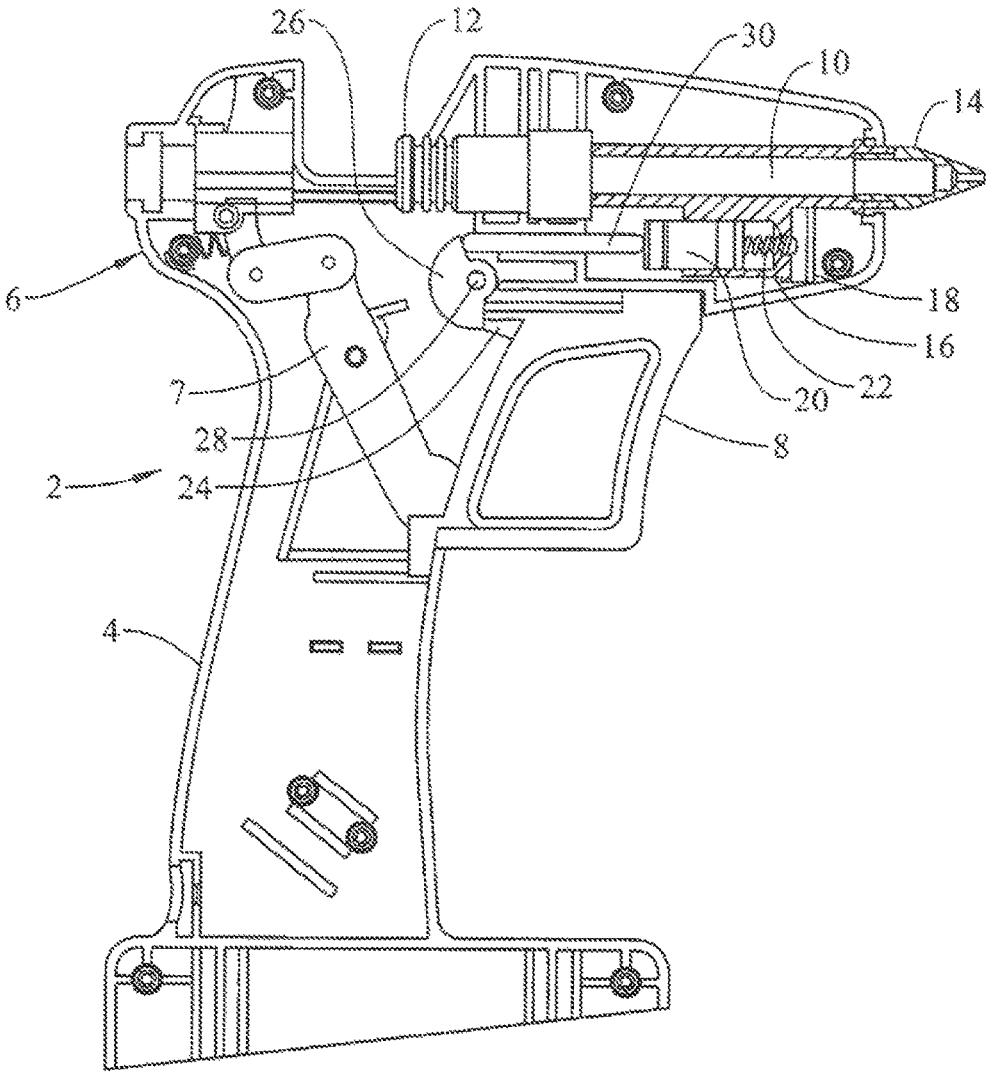
FIG. 1 shows the left side of the housing of a first embodiment of a glue gun with certain of the interior elements being shown in vertical cross section.

With reference to the drawing figures, elements providing similar functions are generally identified by the same reference numerals.

FIG. 1 shows a first embodiment of the invention. A hot melt glue gun 2 includes a body portion 4 having a glue stick advancing mechanism 6. The glue stick advancing mechanism includes a trigger 8, which engages a pivotally mounted lever 7 to advance a glue stick 9 (see FIG. 3) into a melt chamber 10.

The melt chamber 10 is heated by electric heating elements 11 (see FIG. 3) and is typically made of cast metal. A sleeve 12 is provided at the inlet to the melt chamber to seal melted glue in the chamber and to guide a glue stick as it enters the melt chamber. A dispensing nozzle 14 is located at the outlet of the melt chamber. This nozzle typically includes a ball check valve 15 (see FIG. 3), the ball being held against a valve seat by a spring 17 (see FIG. 3) such that the glue must be under a certain pressure before the check valve will open and allow melted glue to be dispensed.

Adjacent the melt chamber 10 is an auxiliary chamber 16 that is connected to the melt chamber by a tubular passage 18. A piston 20 located in the auxiliary chamber 16 can move in the chamber toward and away from the tubular passage. When the piston 20 is moved in a direction away from the tubular passage 18 the pressure in the auxiliary chamber 16 and the tubular passage 18 will be lowered, and melted glue will flow from the melt chamber into the auxiliary chamber. When the piston is moved in a direction toward the tubular passage 18, the pressure of the glue in the auxiliary chamber 16 increases, forcing glue in the auxiliary chamber through the passage 18 and back into the melt chamber 10.

Preferably the auxiliary chamber is a part of a metal casting that also forms the melt chamber 10 and is heated by the same electric heating elements that heat the melt chamber 10. Thus, the temperature of the auxiliary chamber is high enough to maintain glue in the auxiliary chamber melted when the glue gun is in use and to melt any cold glue in that chamber during startup. The auxiliary chamber could, however, be formed in a separate casting and heated by the same heater that heats the melt chamber or a separate one.

When glue is to be dispensed, a user squeezes the trigger 8, pulling it toward the body 4 of the glue gun. A stem 24 on the back of the trigger engages one side of a lever 26 that is rotationally mounted to the body at a pin 28. The other side of the lever 26 engages a shaft 30 that in turn engages the rear of the piston 20, forcing the piston forward. When the piston moves forward, toward the passage 18, the glue in the auxiliary chamber is forced through the passage 18 back into the melt chamber and becomes part of the glue that is dispensed.

When the user's pressure on the trigger 8 is released, however, the force applied by the lever 26 to the shaft 30 is released, which also releases the force applied by the shaft 30 on the piston and allows the spring 22 to drive the piston away from the passage, thus drawing glue from the melt chamber 10.

Figure 2:
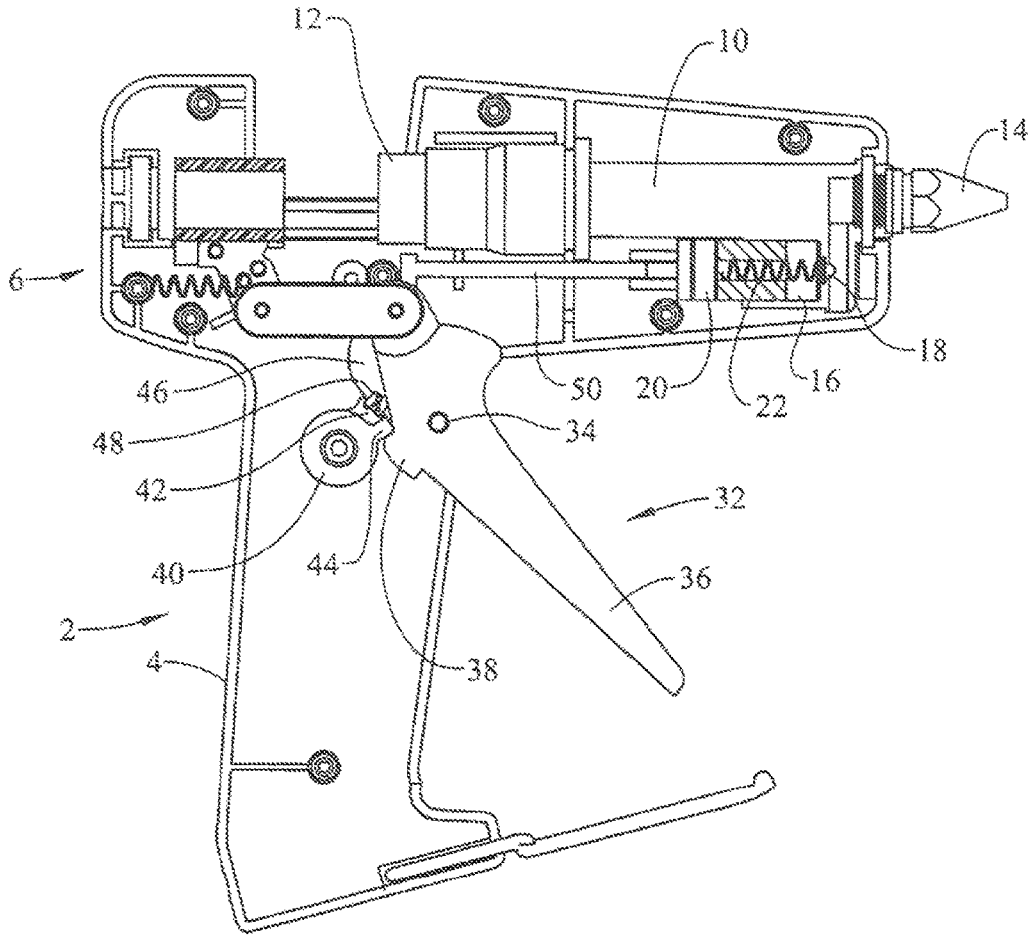
FIG. 2 shows the left side of the housing of a second embodiment of a glue gun with certain of the interior elements being shown in vertical cross section.

The embodiment of FIG. 2 illustrates an alternate trigger mechanism. In this embodiment, the trigger 32 is mounted to the body 4 for rotation about the pin 34. The trigger 32 is mounted such that a user can engage the lower portion 36 of the trigger and dispense glue by pulling that portion toward the body 4 of the glue gun. One side of the trigger 32 includes a boss 38 that rotates upwardly when a user pulls on portion 36 of the trigger. A toothed disc 40 having teeth 42 is mounted adjacent the trigger 34. The disc 40 has a boss 44, which engages boss 38 on the trigger. Upon motion of the trigger 32 toward the body of the glue gun the two bosses 38 and 44 engage to drive disc 40 counterclockwise. A cam 46 is pivotally mounted on the body and has teeth 48 that are in contact with teeth 42, whereby counterclockwise rotation of the disc 40 drives the cam 46 clockwise. An upper part (not shown) of the cam 46 engages a shaft 50, an opposite end of which engages the piston 20. When the user pulls on the trigger 32, the end of the shaft 50 in contact with the piston pushes the piston toward the passage 18 to return any glue in the auxiliary chamber to the melt chamber. When the user releases pressure on the trigger 36, spring 22 pushes the piston away from the passage 18, which returns the cam 46 and disc 40 to the positions shown in FIG. 2 and draws glue out of the melt chamber to relieve pressure in the melt chamber and evacuate glue from the nozzle to prevent dripping.

Figure 3:
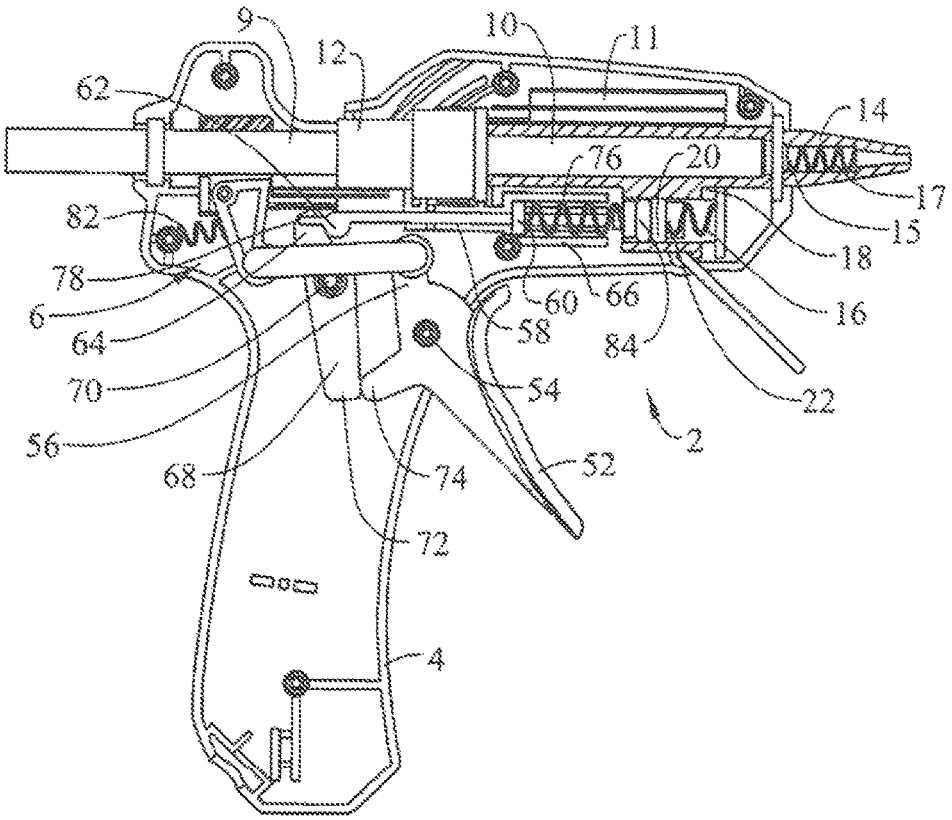
FIG. 3 shows the eft side of the housing of a third embodiment of a glue gun with certain of the interior elements being shown in vertical cross section.

FIG. 3 illustrates another embodiment of a glue gun in accordance with the invention. The embodiment of FIG. 3 is similar to those of FIGS. 1 and 2 but FIG. 3 additionally shows the glue stick 9 and the electric heating element 11. FIG. 3 also shows a known spring-controlled ball check valve 15 inside the dispensing nozzle 14. A spring 17 urges the ball against a seat to bias the check valve in a closed condition preventing flow of glue into the nozzle.

In the embodiment of FIG. 3 the mechanism that operates the movable piston 20 is provided with a pressure relief spring 76 to prevent breakage of the mechanism when the glue advancing mechanism is operated before the glue is sufficiently melted or the piston is otherwise prevented from moving freely in the auxiliary chamber 16. In this embodiment a trigger 52 is pivotally attached to the housing 4 at a pivot pin 54, and an upper part 56 of the trigger is pivotally connected to the glue advancement mechanism 6 whereby a user's rotation of the trigger 52 toward the housing advances the glue stick into the melt chamber 10 to dispense glue. The motion of the piston 20 is controlled by a piston actuation shaft 58, which is positioned adjacent the auxiliary chamber 16. The piston actuation shaft is located just below the melt chamber with one end 60 supported in relief spring housing 66 for linear motion toward and away from the piston 20. The opposite end 62 of the piston actuation shaft is supported on an upper portion 64 of a bar 68, which is pivotally mounted on the housing at pin 70. A lower part 72 of the bar 68 is positioned to engage a projection 74 of the trigger 52.

When a user initiates the dispensing of glue by pulling the trigger 52 toward the housing 4, projection 74 moves the lower end 72 of the bar 68 in a clockwise direction, and upper end 64 of the bar 68 engages end 62 of the piston actuation shaft to move the shaft toward the piston 20. A pressure relief spring 76 is located between end 60 of the piston actuation shaft and piston 20. Movement of the actuation shaft in a rightward direction in turn moves the piston 20 to the right to force melted glue from the auxiliary chamber 16. If the user pulls on the trigger 52 before glue in the auxiliary chamber is sufficiently melted, or there is an obstruction to free motion of the piston, spring 76 will compress to prevent damage to other parts of the glue-gun mechanism.

In the embodiment illustrated in FIG. 3, end 62 of the piston actuation shaft is cylindrical and the upper part 64 of the bar 68 is shaped to provide a smooth motion of the piston actuation shaft 58 during dispensing of glue. Projections 78 extend on opposite sides of upper end 64 to maintain alignment of end 62 of the shaft with end 64 of the bar. Spring 76 ensures continuous contact between the two ends.

When a user releases pressure on the trigger 52, a spring 82 in the glue advancement mechanism urges trigger 52 toward its initial position, and spring 22 urges piston 20 to the left of FIG. 3 to withdraw glue into auxiliary chamber 16 to prevent the dripping of glue from dispensing nozzle 14.

FIG. 3 also illustrates O-ring 84 on the piston to seal the auxiliary chamber and prevent leakage of glue past the piston.

In use, the glue gun disclosed operates to force glue out of the auxiliary chamber 16 when a user pulls on the trigger, by pushing the piston toward the passage 18. This returns the glue in the auxiliary chamber to the melt chamber for mixing with the glue already in the melt chamber for dispensing. Conversely, when the user releases pressure on the trigger, the spring 22 pushes the piston 20 away from passage 18, thus drawing glue from the melt chamber and relieving the pressure in the chamber to reduce dripping.

As noted above, glue experiences a thermal volume expansion of about 5% during melting. Thus, advancement of the glue stick into the melt chamber during discharge of melted glue through the nozzle adds solid glue to the melt chamber, which expands as it melts. Upon termination of glue discharge, the volume of glue withdrawn into the auxiliary chamber fully or at least partially empties the nozzle. Even partial emptying of the nozzle greatly reduces or even eliminates dripping of the glue from the nozzle. The volume withdrawn can also be large enough to include the glue expansion resulting from heating un-melted glue added to the melt chamber by advancing the glue stick during discharge. In an embodiment, the auxiliary chamber withdraws a volume of melted glue in the range of 25-35% of the volume of solid glue added to the chamber during a discharge.

Use of the auxiliary chamber described above with a ball check valve in the nozzle, as illustrated in FIG. 3 provides a particular advantage. When the user's pressure on the trigger is released, the piston 20 can quickly withdraw glue from the melt chamber in the immediate area of the passage 16, which also pulls glue back from the nozzle. This reduction of pressure in the glue allows the ball check valve to close quickly, resulting in a quick cutoff of the glue discharge. This contrasts with prior art glue guns where the check valve closes slowly as the pressure in the melt chamber bleeds off, resulting in dripping and stringing. In addition, withdrawal of glue from the nozzle in the glue gun of the invention pulls glue away from the nozzle tip, causing turbulence in the melted glue. This turbulence further reduces or eliminates stringing of the glue as well as dripping.

While the auxiliary chamber has been illustrated as extending essentially parallel to the melt chamber, it can be oriented in other directions. For example, the auxiliary chamber can be oriented such that the piston moves transversely to the longitudinal axis of the melt chamber. As well, it is within the scope of the invention that the auxiliary chamber can extend into the melt chamber. Alternatively, the piston alone can be arranged to move into and out of the melt chamber to withdraw melted glue into the space occupied by the piston during dispensing.

It will be appreciated that in the disclosed embodiments, movement of the piston is coordinated with the operation of a glue-stick advancing mechanism. In the embodiments disclosed, movement of the piston is mechanically controlled by such operation, but it is within the scope of the disclosure to provide for other methods of control, such as electronic, pneumatic, or fluid.

Modifications within the scope of the appended claims will be apparent to those of skill in the art.

I claim:

1. In a hot melt glue gun (2) having a glue stick advancing mechanism (6) for advancing glue into a melt chamber (10), characterized in that an auxiliary chamber (16) is positioned to receive melted glue from the melt chamber (10), a passage (18) connects the melt chamber (10) to the auxiliary chamber (16), and an assembly that cooperates with the trigger to draw melted glue from the melt chamber into the auxiliary chamber upon termination of dispensing of glue and returns glue from said auxiliary chamber when dispensing of glue begins.

2. A hot melt glue gun (2) comprising a body (4), a melt chamber (10) mounted in said body (4) for heating a glue composition, a discharge nozzle (14) connected to said melt chamber (10) for receiving glue therefrom and discharging glue, and a glue stick advancement mechanism (6) for selectively supplying glue to said melt chamber (10) and causing glue in said melt chamber to discharge through said discharge nozzle (14), characterized by an auxiliary chamber (16) in fluid communication with said melt chamber (10), a siphon mechanism (20) that draws glue from said melt chamber into said auxiliary chamber upon termination of the supply of glue to said melt chamber (10) by said glue advancement mechanism (6).

3. A hot melt glue gun according to claim 2 wherein said siphon mechanism (20) returns glue in said auxiliary chamber (16) to said melt chamber (10) when said glue advancement mechanism (6) causes glue to discharge.

4. A hot melt glue gun according to claim 3 wherein said siphon mechanism comprises a piston (20) that is movable within said auxiliary chamber (16) to vary the volume of said auxiliary chamber selectively.

5. A hot melt glue gun according to claim 4 wherein said siphon mechanism (20) cooperates with a shaft (30, 50, 58) that moves said piston to force glue from said auxiliary chamber.

6. A hot melt glue gun according to claim 5 wherein said shaft (30, 50, 58) moves in concert with movement of said trigger (8, 36, 52).

7. A hot melt glue gun according to claim 6 wherein said trigger (52) engages a bar (68) that is pivotally mounted to said body and said bar engages said shaft (58) to move said shaft.

8. A hot melt glue gun according to claim 2 characterize in that a check valve (15) is positioned between said melt chamber (10) and said discharge nozzle (14), said check valve (15) being biased toward a closed condition that prevents flow of glue from said melt chamber to said discharge nozzle and being placed in an open condition that passes glue from said melt chamber to said nozzle when the pressure in said melt chamber exceeds a predetermined amount, and a passage (18) in fluid communication between said auxiliary chamber and said melt chamber for conducting a flow of glue.

* * * * *